US005104004A

United States Patent [19]

von Schuckmann

[11] Patent Number: 5,104,004

[45] Date of Patent: Apr. 14, 1992

[54] DISPENSER HAVING PISTON WITH CHANNEL FOR PASSING A STORED SUBSTANCE

[75] Inventor: Alfred von Schuckmann, Kervendonk 63, 4178 Kevelaer 2, Fed. Rep. of Germany

[73] Assignee: Alfred von Schuckmann, Kevelaer, Fed. Rep. of Germany

[21] Appl. No.: 460,423

[22] Filed: Jan. 3, 1990

[30] Foreign Application Priority Data

Jan. 7, 1989 [DE] Fed. Rep. of Germany ..... 3900267

[51] Int. Cl.[5] ..... B67D 5/42

[52] U.S. Cl. ..... 222/135; 222/257; 222/320; 222/385

[58] Field of Search ..... 222/383-387, 222/94, 145, 135, 136, 372, 325, 326, 327, 320, 257, 256

[56] References Cited

U.S. PATENT DOCUMENTS

| | | | |
|---|---|---|---|
| 3,268,123 | 8/1966 | Spatz | 222/400.5 |
| 3,870,200 | 3/1975 | Spatz | 222/206 |
| 3,877,617 | 4/1975 | Stevens | 222/321 |
| 4,438,871 | 3/1984 | Eckert | 222/326 X |
| 4,511,068 | 4/1985 | Bossing | 222/387 X |
| 4,657,161 | 4/1987 | Endo et al. | 222/383 X |
| 4,775,080 | 10/1988 | Mettenbrink | 222/391 |
| 4,793,522 | 12/1988 | Corsette | 222/387 X |
| 4,796,786 | 1/1989 | Czech | 222/256 |
| 4,848,595 | 7/1989 | Foster et al. | 222/402.11 X |
| 4,848,598 | 7/1989 | McKinney | 222/391 |
| 4,875,604 | 10/1989 | Czech | 222/383 X |
| 4,949,875 | 8/1990 | Kuo | 222/383 X |
| 4,967,937 | 11/1990 | von Schuckmann | 222/257 X |
| 5,014,881 | 5/1991 | Andris | 222/383 X |
| 5,042,694 | 8/1991 | Birmelin | 222/383 X |
| 5,044,525 | 9/1991 | McKinney | 222/386 X |

*Primary Examiner*—Michael S. Huppert
*Assistant Examiner*—Kenneth DeRosa
*Attorney, Agent, or Firm*—Martin A. Farber

[57] ABSTRACT

The dispenser consists of a container which contains a portion of a paste-like material. The dispenser has an internal check valve and an internal spring for biasing the dispenser actuator. At the lower part of the container is a piston which moves upwardly as the paste-like material is dispensed from the container. This dispenser due to the flow of material can be adapted to put stripes onto the main paste-like material stream. In addition, the dispenser can be adapted to function as an atomizer. As an atomizer, a tube will extend downwardly from the pump head to the bottom of the container. Also, the discharge spout will have an atomizing orifice.

18 Claims, 7 Drawing Sheets

DISPENSER HAVING PISTON WITH CHANNEL FOR PASSING A STORED SUBSTANCE

Figure 1:
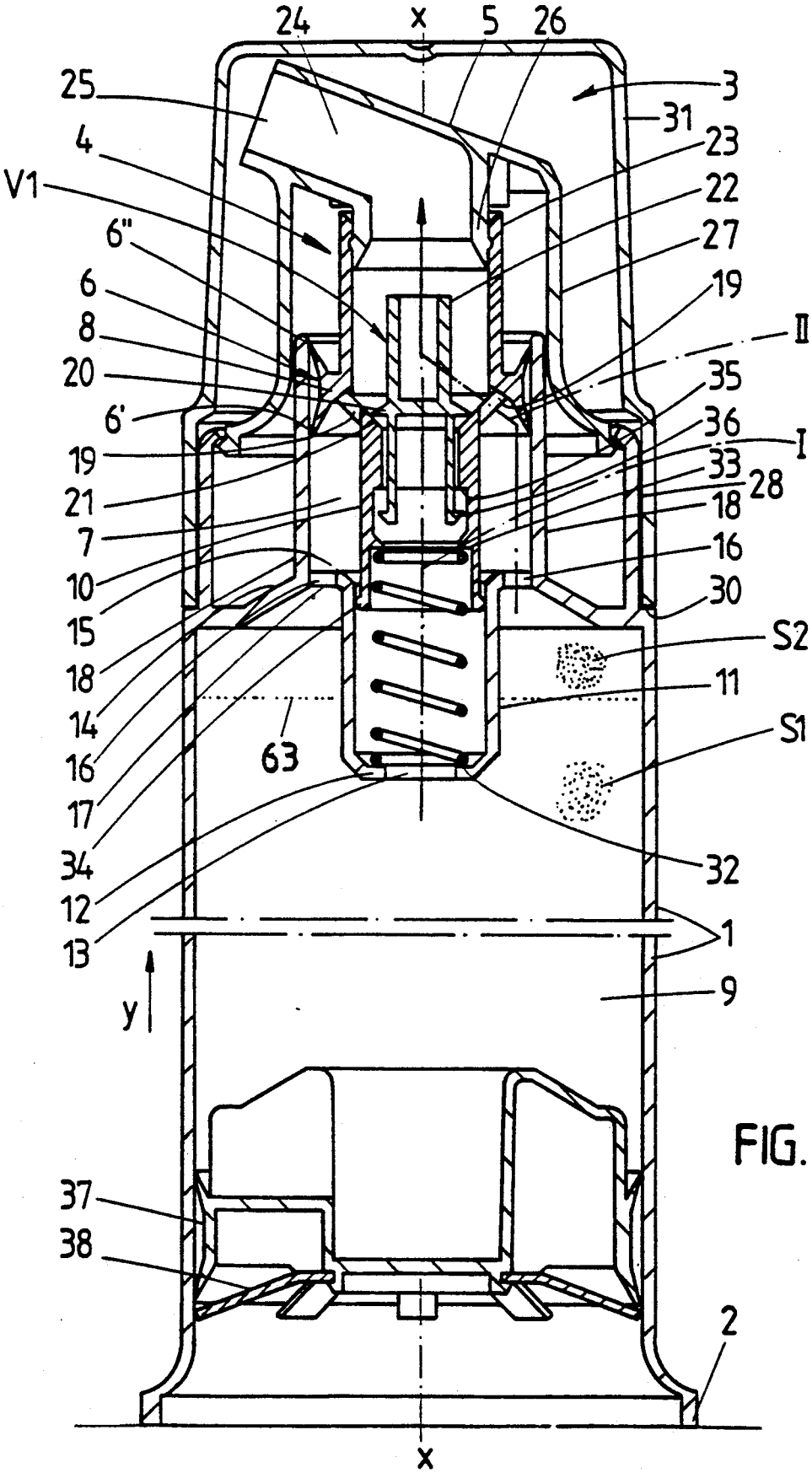

The invention pertains to a dispenser for the portioned output of different viscous substances.

A dispenser of this type is known from U.S. Pat. No. 3,877,617. It has a pump device equipped with at least one valve-closing element located at the tip end of the vessel. The pump contains a piston moveable under spring tension in an axially aligned cylinder chamber. Its motion takes place via an actuator which also forms a mouthpiece channel. The underside of the piston is formed into a guide tube which moves in the bottom passage of the cylinder chamber. The passage opening is formed within a coaxial pipe joining the cylinder chamber. The pipe's cross-section is clearly smaller than the inside diameter of the cylinder chamber. This gives one stage. The pump device does not have central flow-through by the output substance, in spite of the central placement of the piston. Rather, it is diverted within the cylinder chamber.

The guide tube has a closed transverse wall. Above and underneath this transverse wall there is a radial aligned cutoff channel. The latter opens into said cylinder chamber and is alternately closed by the actuator. To do this, the moving shaft of the valve seat is pulled up to the stop-limited guide tube. This shaft also forms a slide-like barrier element. All this leads to a quite complicated design of the pump device for which precision-manufactured parts are needed. The central detour of the substance represents a problem for viscous substances, especially for paste-like substances. A lateral pileup of the substance takes place since it is not immediately distributed. Accordingly, the piston is not exposed to the same load. The result is a clamped, transverse position which also can restrict the pusher function. Consequently, this dispenser can be used practically only for limited types of substances, especially liquid substances. When used for viscous substances, there is the problem of degassing when filling. The subsequent lack of material flow usually leads to malfunctions.

The objective of the present invention is to improve such a dispenser by equipping it with a central running piston using a simplified design with regard to degassing and functionality, even when using higher viscosity substances, including pastes.

This problem is solved by the invention described in this application for patent.

As a result of such design, a dispenser of increased utility is achieved. This improvement resides in the high functional reliability achieved for even considerably differing internal resistances of the substances being dispensed. To this extent, we can even talk about universal uses. The substance stream is moved centrally and practically detour-free by the dispenser head: with force-distorting detours of the substance and the use of a slide valve being avoided. Thus, the expression of the material from the guide tube and subsequent reintroduction of the material into the guide tube, as needed in the prior state-of-the-art, is eliminated. Rather, rotation-symmetrical and equal hydraulic conditions prevail. Even the gap between the guide tube and the surrounding cylinder chamber forming the guide for the piston, is held free of restriction in this case. The actual process is that the cross-sectional reduction stage has substance passage openings, and the pipes and guide tube form a substance flow channel open in the axis direction and containing a valve-closing element. This channel extends out to the mouthpiece. The substance passage openings allow a "flushing" of the mantle wall of the guide tube with material. This causes not only a favorable lubricant effect, but creates a cohesive pressure volume of the guide-tube surrounding material with the vessel-wall material. The surrounding material is carried along uniformly.

In order to create an air-free state the filling, occurring from the base of the dispenser, takes place with the piston pressed in or guide tube pressed in. By releasing the actuator, the cylinder chamber draws the material in without bubbles. The corresponding basic system can be modified by simple means into a stripe dispenser, e.g., by a partial material flow entering via the material passage openings into the cylinder chamber and exiting through smaller cross-sectional openings in the valve seat. This partial material flow runs parallel to the material flow channel and meets it beyond the valve-closing element. As was found, the stripe composed, e.g., of a so-called mouthwash component, is applied precisely onto the lane (e.g., of a toothpaste) passing the central substance flow channel. The smaller openings (compared to the material passage openings) in the valve seat output only a partial volume for the stripe formation under each actuator stroke. Here too, the central system proves to be particularly favorable. All stripes are generated with equal precision. The non-output volume fraction is shifted in the direction of the vessel chamber. The space for the second, perhaps colored stripe-forming component, is obtained due to the pipe protruding into the first component. The downwardly directed standoff position of the pipe prevents the primary material from moving fully distortion-free through the stated pipe into the material transit channel, in spite of the "breath like" shift of the material present in the cylinder chamber. This pipe quasi-functions as a wall divider in a rotation-symmetrical sense. The decentral inlet of the primary material necessarily occurs in a calm section. The opening for the primary material and the material transit opening to the cylinder reside at an axially distanced level. From the flow point of view, the problem is best solved by a Y-shaped joining of the partial material flows to the side of a continuation piece provided at the valve-closing element. The continuation piece extends into the input tube section of the mouthpiece channel. This Y-shaped combining is understood to be rotation symmetrical, relative to the stacked or axially placed material transit openings to the openings in the valve seat. Also, with regard to the guide tube, the design has at least one shoulder, reducing the inner cross-section. Such shoulders act piston-like, and thus contribute, like the front end of the guide tube, to the output of the materials. In order to prevent even minor mixing of substances with the core element of the dispenser, the guide tube is in contact with an annular bulge at the inside wall of the pipe. This type of annular bulge acts like a kind of sealing stripper lip. An auxiliary function is performed by the guide tube, since the pump springs mesh with the interior of this guide tube and are braced against one of the shoulders, e.g., the specified shoulder. In this manner a spring chamber, providing optimum protection for the pump springs, is formed in participation with the pipe. The valve-closing element is also in the cavity of the guide tube.

In a refinement, an additional valve-closing element can sit in the inlet opening of the pipe. Alternatively, we have a valve element with valve seat in the inlet channel which is moved by the pressure of the pumped material in the opening direction opposite a spring action. This creates a type of self-closing system for the inlet channel. Since the sealing takes place at the outer end, restrictions of material can be eliminated; e.g., if said material consists of spoilable foodstuffs. One favorable design with regard to the assignment of the actuator stroke, and especially with regard to the spray aspect, is obtained by adhering the actuator key onto the free end of the inlet tube section coaxial to the guide tube and having a greater cross-section. An irreversible adhesion is preferred. A reversible clip joint would have the advantage that actuator strokes could be allocated to different channel inlets. This expands the use of different calibers for correspondingly different materials. The actions to configure the valve seat in the form of an upwardly open blunt cone, creates the best conditions to obtain the Y-shaped guide path and an optimum valve seat surface.

In order to counter the environmentally unsound, one-time use of the dispenser and wastage of raw materials, a favorable refinement is to design the pipe as an insertion and connecting pipe to a cartridge, forming the vessel inner chamber. Docking takes place using the so-called central system and has the advantage of an immersion-tube-like pipe. It is also an advantage if the cartridge equipped with a tracking piston, can be inserted from the pump side into the vessel, and the pump device can be set onto the upper edge of the housing surrounding the cartridge by inserting the pipe into the cartridge so that the protrusion provided at the base of the housing shifts in the direction of the pump device when setting the tracking piston into the cartridge. The correspondingly compressed material penetrates into the dispenser head and thus yields the advantage of strokeless, immediate output. A stabilization advantage for the protrusion is achieved by shaping it as an annular wall. Very small wall thickness can be used here, since the stress is applied on the longitudinal axis of the annular wall. At the corresponding transfer of the material from the cartridge into the dispenser head, the cartridge is equipped with leads aligned with the material transit openings, and on the outside, the leads are equipped with a sealing rib. The sealing rib is favorable both in the cartridge docking stage and also for cover sealing. The sealing surface is formed by the underside of the dispenser head or by the inside of the cartridge cover. Also, it is an advantage that the head piece of the dispenser, containing the pump device, has a collar screwed to the inside wall of the housing. This collar has a front surface set onto a ring joint of the cartridge.

In order to achieve a smooth seal, the edge of the head-piece cover is aligned to the housing mantle wall. While generally retaining the basic components, a similar box-like design of the dispenser is possible in the form of an atomizer. To do this, proceed so that the flow channel forms a valve-sealing pump chamber with the guide tube as a hollow piston and the pipe as the cylinder chamber. The latter is connected via a hose to the lower region of the vessel chamber. In this regard, the invention also proposes that the hose be connected to the pipe and that the inner wall of the cylinder chamber have an essentially axially aligned ventilation groove which opens toward the vessel chamber and ends in front of the lower edge of the valve seat, so that the length of the valve seat is shorter than the ventilation groove.

The object of the invention is explained below with reference to several figures.

FIG. 1: A vertical cross-section through the dispenser per the first design, shown in outline, with a valve-closing element and tracking piston blocked on one side, FIG. 2: A vertical cross-section per FIG. 1 in the output position, FIG. 3: The dispenser, per a second design, likewise in vertical cross-section and in the base setting, with two valve-closing elements and the tracking piston not, or not necessarily, blocked on one side, FIG. 4: The dispenser, per a third design, again in vertical cross-section, base setting, with a self-closing system, FIG. 5: The dispenser, per a fourth design, partial cross-section, in a so-called cartridge version, FIG. 6: A vertical cross-section through the cover-sealing cartridge in single presentation, and FIG. 7: A vertical cross-section through the dispenser in the form of an atomizer, also in base setting.

The illustrated dispenser for the portioned output of its contents has elongated vessel (1). The latter is of essentially cylindrical design and changes at the base into a larger cross-sectional standing edge (2).

The head end, the so-called dispenser head (3), contains pump device (4) which is activated via actuator (5) for portioned output of the vessel contents.

The pump device is composed of piston (6) moving under spring force, and attendant cylinder chamber (7). Piston (6) and cylinder chamber (7) extend in the longitudinal middle axis x—x of the dispenser. The piston's outer diameter corresponds to the radius of vessel (1).

Piston (6) has media flowing centrally (compare material-flow channel I). Its valve seat (8) is broken through accordingly and continues in the direction of vessel inner chamber (9) into guide tube (10). It is in contact with the inner seat edge of valve seat (8) and forms a single piece. The lower end of guide tube (10) lying on the other side of cylinder chamber (7), slides along the inner wall of fixed pipe (11) and forms a seal.

Pipe (11) has at its lowest point, i.e. in its base (12), an inlet opening (13). Pipe (11) has an essentially cylindrical configuration and goes over on top into smooth and slightly upward bulged cover (14) of container (1). The outer diameter of relatively thin-walled pipe (11) corresponds about to one third of the inside diameter of vessel (1). The length of pipe (11), however, corresponds to at least the stop-limiting actuation stroke of piston (6).

A corresponding, cross-section reducing shoulder is also located between cylinder chamber (7) and pipe (11). The essentially horizontal protrusion zone creates one stage. The latter bears reference designation (15).

The cross-section reducing stage has material transit openings (16). These are circular slitted segments interrupted by relatively small bars (17). There are four bars (17) and they represent the sole material bridge between wall (18) of cylinder chamber (7) or cover (14) of vessel (1) and form the shaped support for pipe (11), and create a three-legged junction. Due to material transit openings (16) a flow connection is created between vessel interior (9) and cylinder chamber (7). In accordance with the lifting motion of pump device (4) or piston (6) respectively, the substance entering annular cylinder chamber (7) can "breathe". It is pushed back and forth. In order to keep cylinder chamber (7) free of bubbles when filling the vessel inner chamber (9), which takes place from the lower, open end of vessel (1), a head covering, pump device (4) is brought into the actuation position (see FIG. 2). Due to the spring-loaded resetting of piston (6), cylinder chamber (7) is drawn full.

Figure 2:
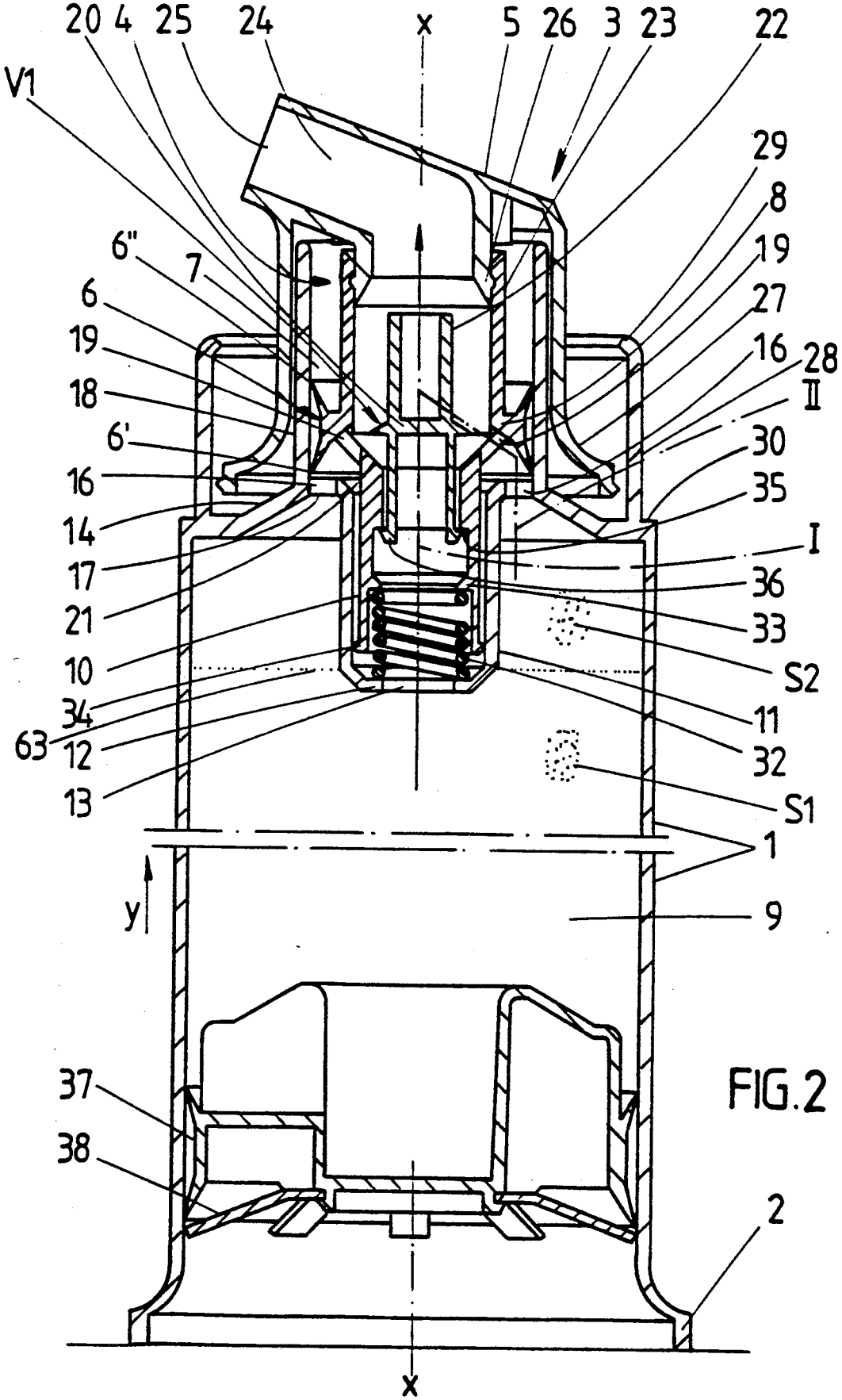
Figure 3:
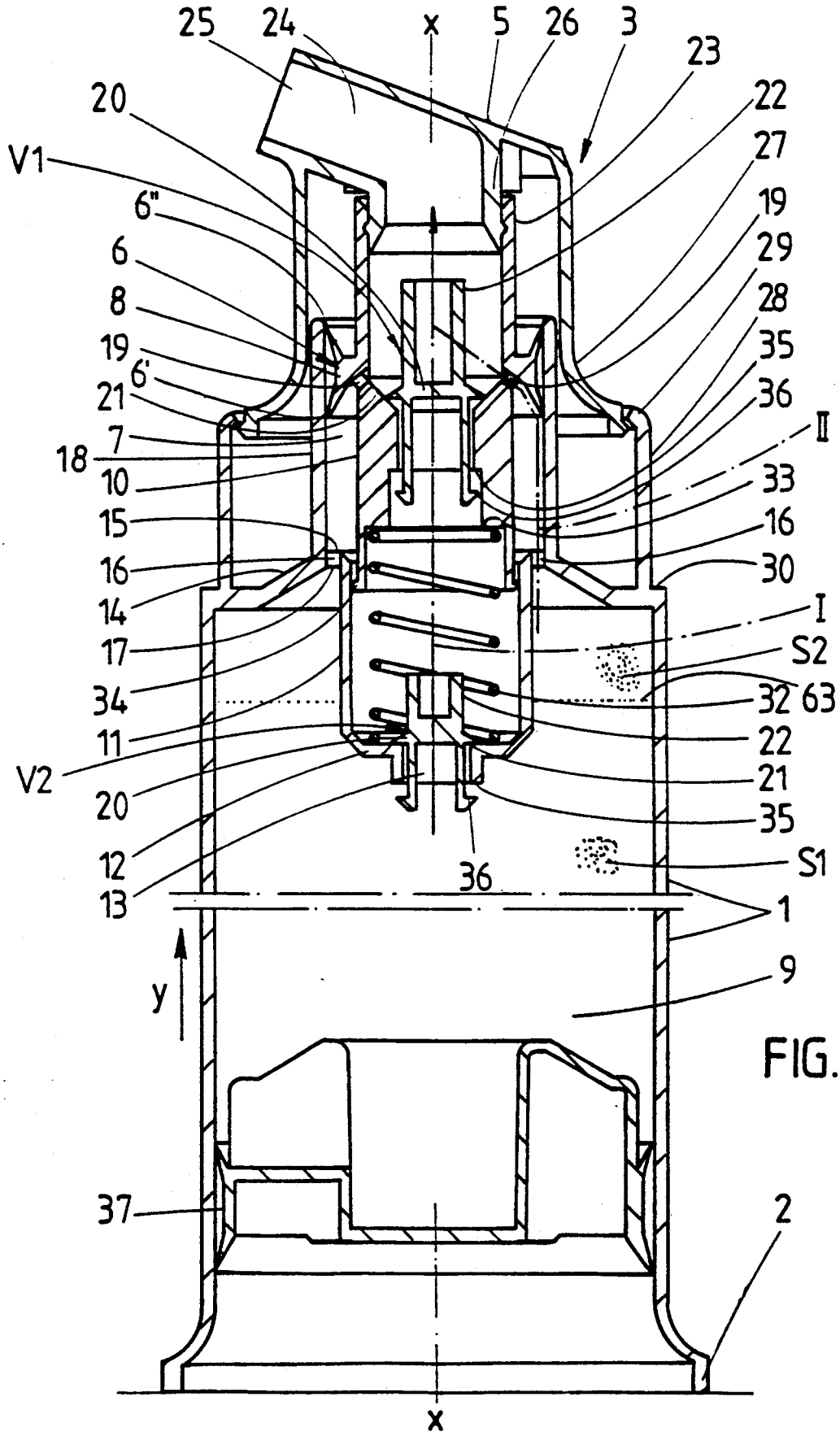

In the design examples per FIGS. 1, 2 and 3, a refinement of the dispenser is a so-called stripe dispenser. Thus, only a minor change in piston (6) is required. The corresponding action is characterized by partial material flow II entering cylinder chamber (7) via material transit openings (16) and exiting through cross-section reducing openings (19) in valve seat (8). This partial flow runs parallel to material transit channel I and meets the material flow channel I beyond valve-sealing element V1 inserted into material flow channel I. One material, called the primary material, is called S1. It is e.g., toothpaste. The other, a secondary material, is called S2 and consists e.g., of a color or colored, paste-like mouthwash component. The former forms the largest fraction and is superimposed by the second. The wall of guide tube (10) acts within pump device (4) as a path divider. The wall of guide tube (10) is flushed on both sides by media, i.e., on the inside and outside wall. The two material flows fed from different sources take a Y-shaped course to the upper edge of the funnel-like pit of the valve seat (8). The inserted valve-sealing elements V1 are located underneath the openings (19) and extend into material flow channel I. The latter is axially limited and shifts into the piston element. It has valve head (20) which cooperates with piston valve seat surface (21). The latter is formed by valve seat (8) configured as an upwardly open, blunt, hollow cone.

Valve head (20) of valve sealing element V1 is transformed on top into protrusion (22). The latter extends into input tube segment (23). It is transformed into mouthpiece channel (24). The mouthpiece channel is formed in actuator (5). It is a curved component which forms transverse-directed, slightly rising, lane-like mouthpiece opening (25). Protrusion (22) neutralizes a partial zone of input tube segment (23) and also serves as a mounting frame.

The flow channel segment lying in longitudinal axis x—x is designed as connector (26) and extends into inlet pipe section (23) or is permanently mounted to it. Channel extension (23) extends axially along the axial length of protrusion (22).

Dome-like guide collar (27) running concentric to input tube section (23) runs from the cover of actuator (5). This collar slides along its edge inside annular wall (28) of dispenser head (3). Annular wall (28) is rooted in cover (14) of vessel (1) and its upper, inwardly directed end section forms limiting stop (29) defining the base position of actuator (5). This stop can be overcome for mounting actuator (5).

Annular wall (28) snaps back from the mantle wall of vessel (1) so that annular shoulder (30) remains to limit the set-on of protective cap (31) extending over the dispenser head.

The spring-loaded base position is based on the layering of pump spring (32) which is braced on one side on bottom (12) of pipe (11) and is braced on the other side against ring-like shoulder (33). This shoulder is formed within guide tube (10) and leads to a somewhat reduced interior cross-section.

Corresponding shoulder (33) springs back compared to the free, lower end of guide tube (10). Pump spring (32) extends accordingly into the interior of the guide tube. Pipe (11) forms the remaining section of the spring chamber.

To achieve the desired sealing of guide tube (10), it forms its free, lower end in this region as ring-like bulge (34) that slides on the inside wall of pipe (11). This can also be a lip-like structure.

To achieve a tight guide of piston (6), it has two opposing lips that define lower piston edge (6') and upper piston edge (6'').

At an axial spacing to shoulder (33) of guide tube (10), another shoulder (35) is located on the actuator side. The latter is aligned per FIG. 1 with vessel-side shoulder (33). It is placed so that retaining feet (36) emanating from valve head (20) of valve-sealing element V1 have considerable free space for the back-mesh and axial motion of valve sealing element V1.

While per FIG. 1, valve-closing element V1 is housed in the interior, or in the cavity of guide tube (10), the double valve designs, per the third figure, have an additional valve-sealing element V2 lying in the inlet opening (13) of pipe (11). This valve element V2 is fundamentally of the same design. Instead of the illustrated, flat contact of valve head (20) of the upper, horizontal edge of inlet opening (13), a valve seat surface (21) of funnel-like design could be implemented, as illustrated in FIG. 1 and explained above in the text, by designing base (12) of the pipe to be like valve seat (8) in the form of an upwardly-open, blunt cone or funnel.

This version of the double-valve pump device makes do with one tracking piston (37) that does not need the usual clamping module (38) on the lower side. The clamping module as a rule consists of a gear whose teeth are braced against the inside wall of vessel (1) and allows only one shift of tracker piston (37) in the direction of arrow (y).

Figure 4:
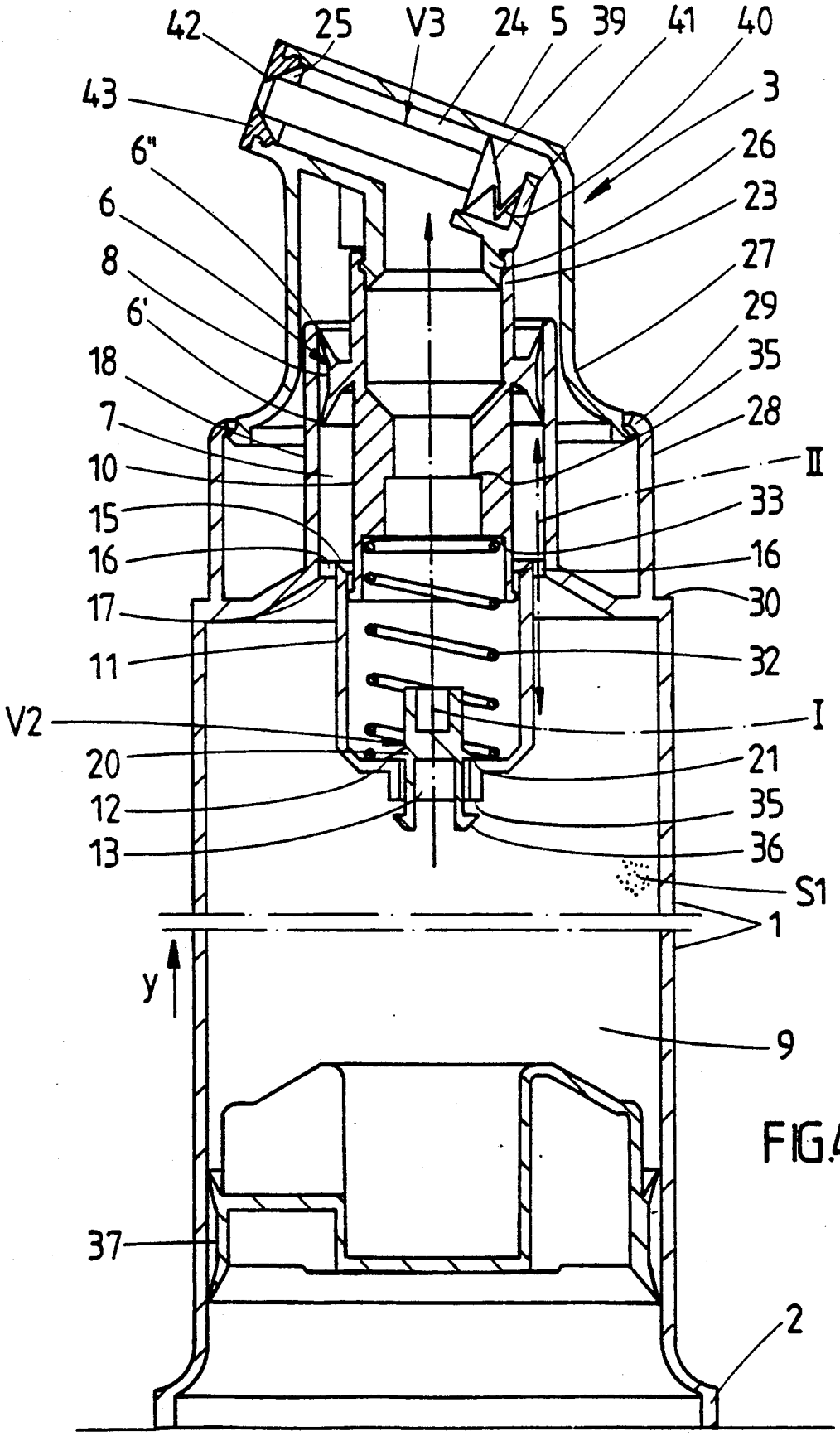

A pump of this type is also preferred in the sample design of FIG. 4. But valve sealing element V3 is lying in the end region of mouthpiece channel (24). This valve-closing element V3 has valve seat (39) that can be shifted under the pressure of the pumped material in the opening direction opposite the force of recoil spring (40). Recoil spring (40) is formed onto the back of the valve seat (39) and is braced against a fixed transverse wall (41). The valve shaft's head end forms a so-called self-closing system. This head end forms a closing cone that moves against corresponding closing shoulder (42). The closing cone and shaft of valve-closing element V3 in this case has a diameter corresponding to about one-third of the inside diameter of mouthpiece channel (24) running laterally upward. In a design simplification, closing shoulder (42) is formed by a piece (43) inserted into mouthpiece opening (25).

Figure 5:
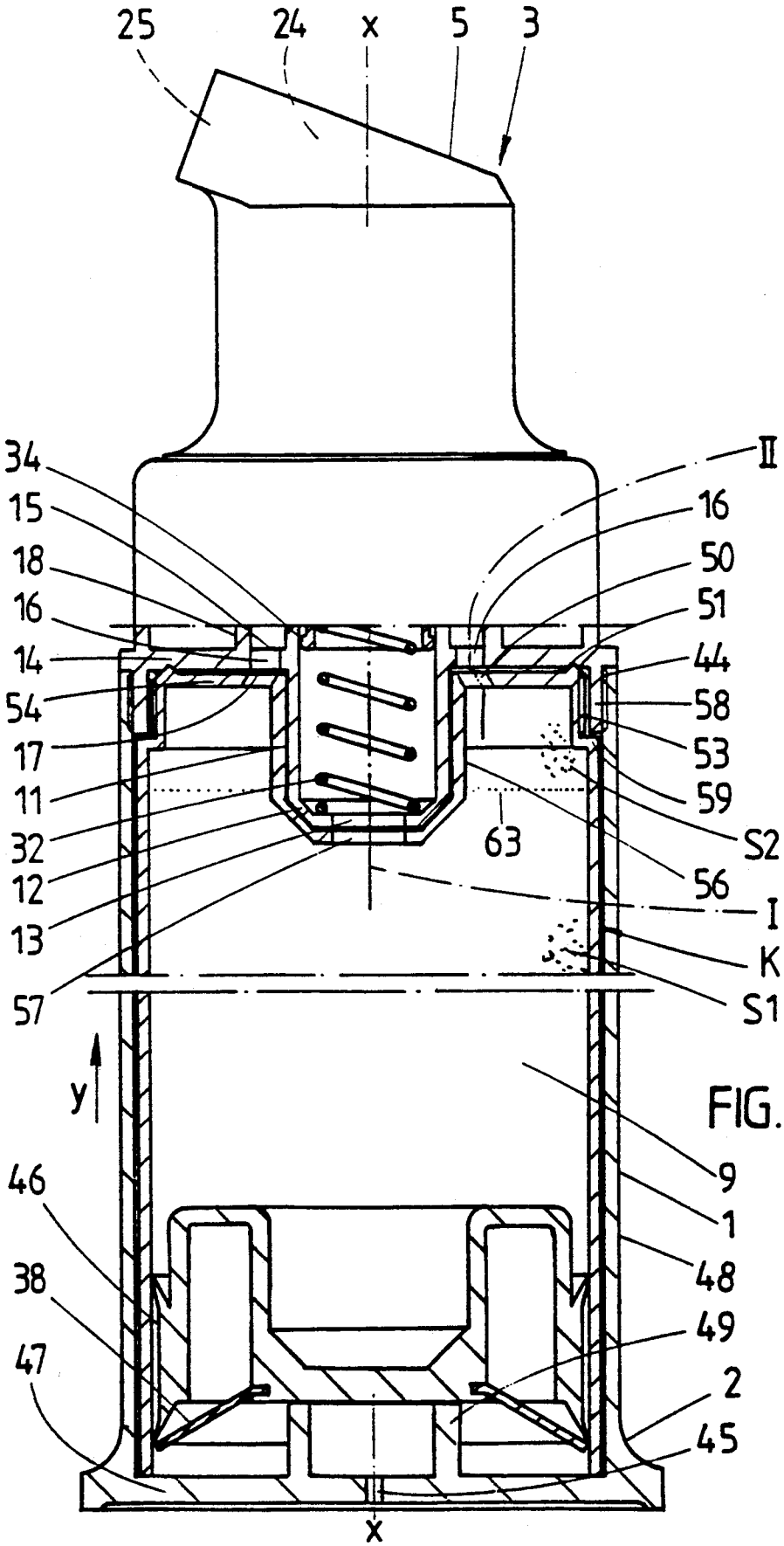

In accordance with FIG. 5, pipe (11) has another function; it forms a type of docking protrusion for cartridge K that is allocated to the dispenser. Cartridge K is in detachable connection with the dispenser or pump device (4) and thus can be replaced at any time or can be replaced by a free cartridge. In this manner, the relatively complicated dispenser can be used repeatedly. Dimensionally, cartridge K is designed so that it can be housed in inner vessel chamber (9) or alternatively forms corresponding vessel (1). It is better if the dispenser housing is divided so that head piece (3) containing the dispenser mechanism and vessel (1) are separable underneath pump device (4). In FIG. 5, the adjustment is made by screw connector (44). In this case, vessel (1) is sealed on the bottom except for air-compensation opening (45).

Cartridge K, designed with tracking piston (46) of adapted diameter, is employed from the pump side into vessel (1). Next, pump device (4) is added in the path of the screw connection. The upper edge of housing (1) surrounding cartridge K enters the cartridge such that protrusion (49) at base (47) of housing (48) shifts the cartridge in the direction of pump device (4) when setting on tracker piston (46). this causes the contents of the cartridge to be pressed into the dispenser head through inlet opening (13) and material transit openings (16) so that the desired connection with the valve site is assured. In this manner, the first actuator stroke of the dispenser can be a complete output stroke.

Naturally, cartridge K also has leads (50) aligned with material transit openings (16). There is shown here a planar alignment. Naturally, the bars dividing the individual slit sections from each other need not be aligned congruently. In order to seal the joint region between dispenser head (3) or pump device (4) and cartridge K so that no material gets into the region of housing (48) of holding cartridge K, sealing rib (51) running concentrically to pipe (11) is provided on the outside of concentrically placed leads (50). This rib has a triangular cross-section and one side of the triangle aligns with the upper side of cartridge cover (54), i.e., a peaked line forms the sealing zone.

Figure 6:
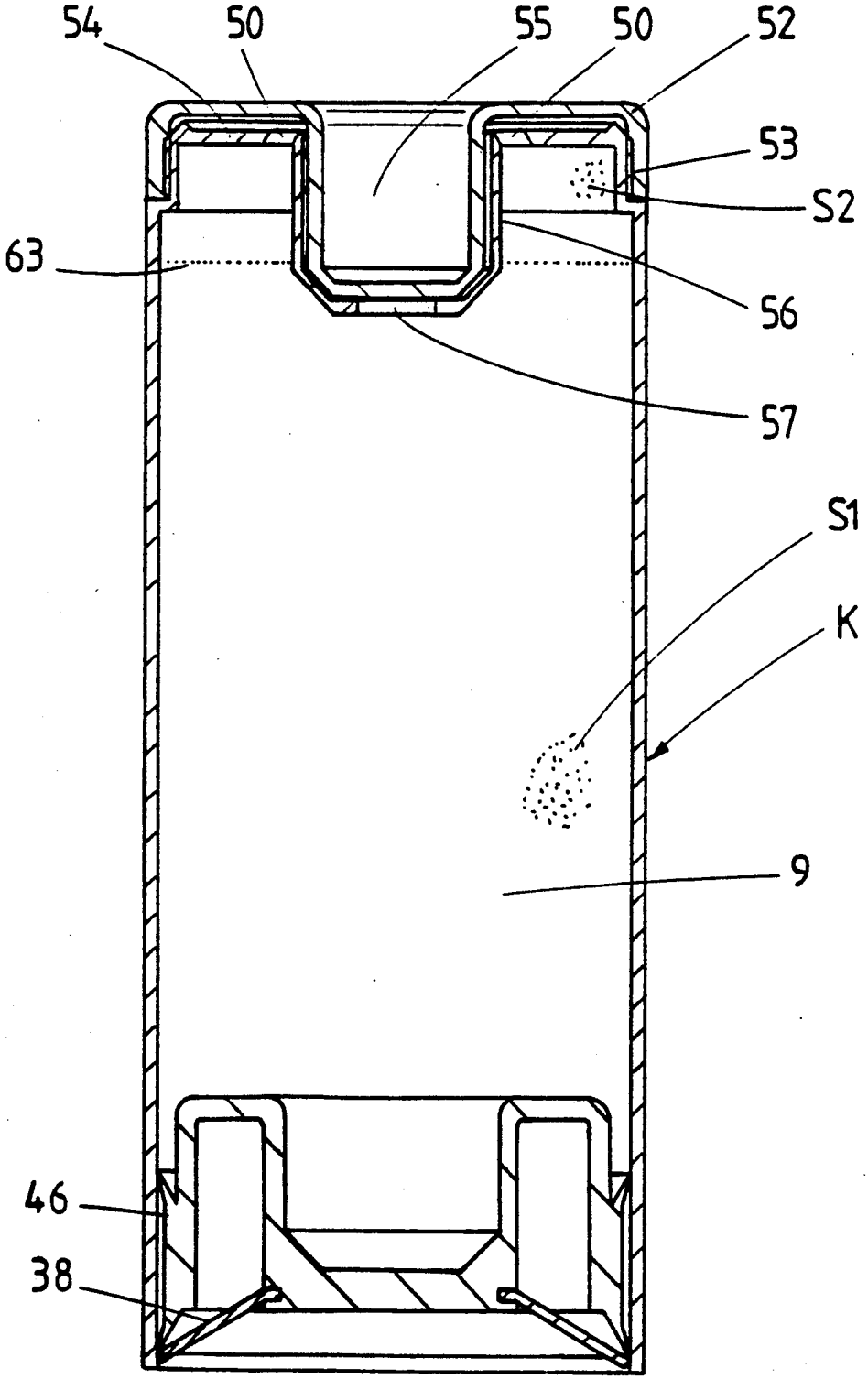

The equivalent function of sealing rib (51) results as a cover (52) sealing cartridge K (see FIG. 6). We are dealing with a screw cover that cooperates with corresponding outer threads (53) of the cartridge. Outer thread (53) is located in a recessed section of the mantle wall of the cartridge whose recessed section is in direct contact with cover (54) of cartridge K. Central contraction (55) of cover (52) fits plug-like, sealing into corresponding contraction (56) of cover (54) of the cartridge. Contraction (55) corresponds to the shape of pipe (11), but has no inlet opening (13). An inlet opening (57) corresponding to inlet opening (13) is located in the base of cartridge-side contraction (56). Both congruent inlet openings (13, 57) have the same inside diameter.

Protrusion (49) is designed as an annular wall an is rooted in base (47) of housing (48). The transverse wall of tracking piston (46) forms a central pot structure whose relatively thick-walled base section cooperates with the front surface of said protrusion (49). The pot-like contraction and the upper contour of the piston take into account the exposed position of pipe (11) or contraction (56).

As FIG. 5 also shows, the design presented is such that head piece (3) of the dispenser containing pump device (4) has a collar (58) screwed to the inner edge of housing (48). The collar's front surface is set onto ring joint (59) of cartridge K attained by the wall offset of the cartridge element. The edge of head piece cover (14) aligns with the housing mantle wall.

Figure 7:
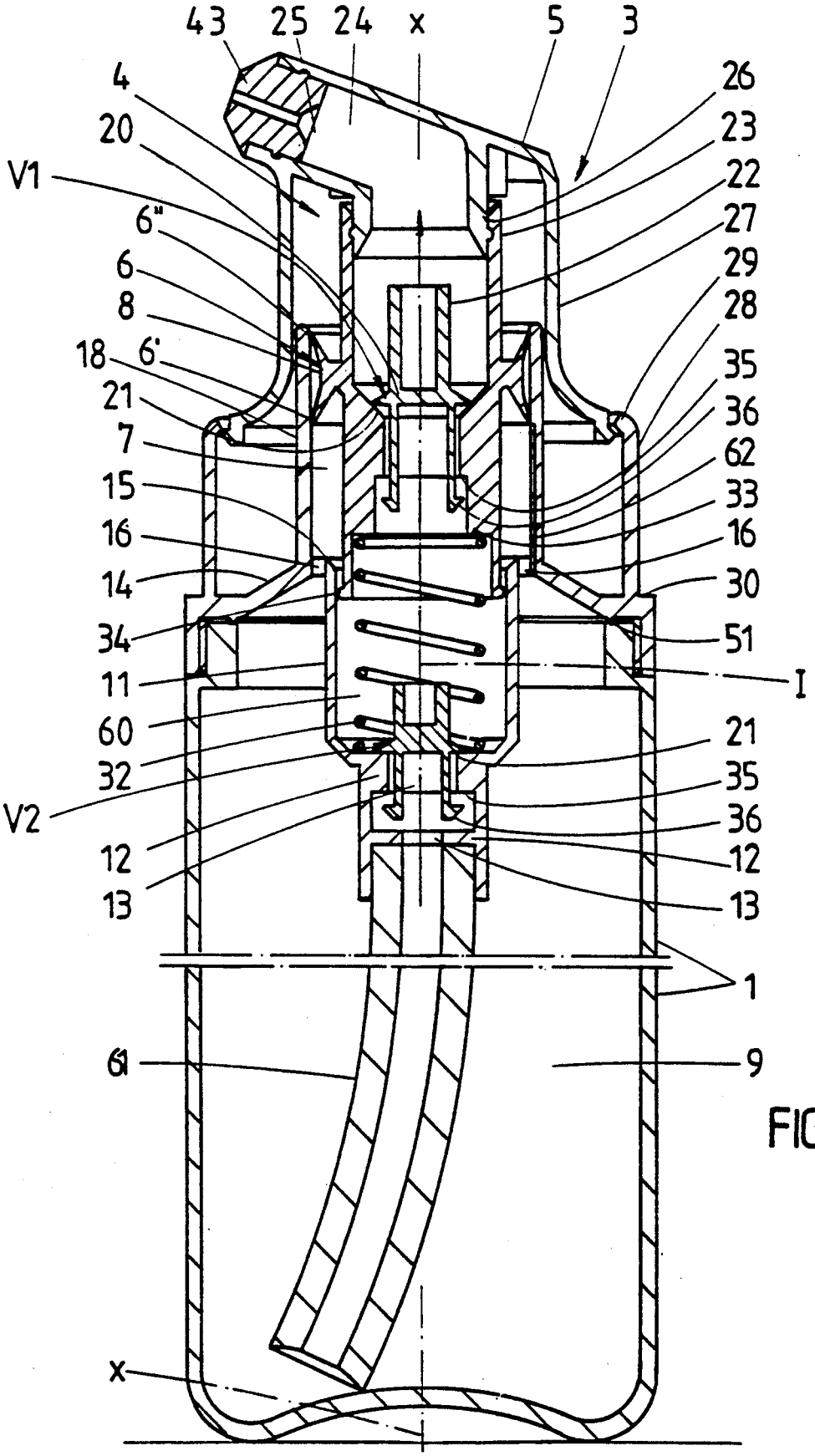

FIG. 7 shows an atomizer model. For the piston, one like that of FIG. 4 can still be used, but openings (19) are omitted. Reference numbers are used accordingly, sometimes without a description in the text. The additional properties are that flow channel I is composed of valve sealing pump chamber (60) with guide tube (10) as a hollow piston and pipe (11) as the cylinder chamber. The latter is connected via hose (61) to the lower region of the interior of vessel chamber (9). Vessel chamber (9) is formed by a bottom sealed vessel. Here too, pipe (11) performs its function by serving to join with hose (61) to create a plug-in connection.

In order to create the needed air equalization for vessel chamber (9), the inner wall of cylinder chamber (7) has essentially axially aligned ventilation groove (62). It opens toward the inside of vessel chamber (9) and thus connects with one of material transit openings (16). Ventilation groove (62) and muzzle opening (25) of the dispenser are located at diametrically opposing points even though height-offset to longitudinal middle axis x—x. Ventilation groove (62) ends upward at lower edge (6') of valve seat (8) in the base position of the pump device. The axial length of valve seat (8) is shorter than the length of ventilation groove (62) in this direction. This ensures that only after passage of one full output stroke that the venting or air equalization will take effect.

The other refinements of this sample design of FIG. 7 pertain to atomizer changes, such as designing a special spray nozzle head. Here too, insert (43) is used with a certain channel caliber. Seals between the dispenser head and vessel are comparable to those of the described examples, with only corresponding sealing lip (51) emanating from dispenser head (3).

The operation of the described figures is briefly summarized as follows:

To FIG. 4: The pump motion causes the material in cylinder chamber (7) to be expelled through equally distributed material transit openings (16). This parallel shifting path has reference designation II. The material there "breathes" similarly over the material transit openings (16) under piston shifting. Once it moves back, cylinder chamber (7) fills again with material. The corresponding exchange promotes the ease of output.

To FIGS. 1 to 3: The stripe dispenser model operates in the same manner, but via upper openings (19) a partial quantity is laid down as a stripe onto the forming lane. The excess material, compressed by reducing the volume of cylinder chamber (7), "breathes" via material transit openings (16). When material S2 presses back down, due to the length of pipe (11), no mixing of materials S1 and S2 will occur. Compression pressure sets both materials under stress, and via inlet opening (13), the primary material passes material transit channel I. The forked-like inlet of the second component, i.e., the combining of the partial material flow with the primary flow, takes place above the valve head (20) of valve-closing element V1. The covering takes place in a wider channel zone which is tapered again above protrusion (22). The lane is finally formed in a completely turbulence-free zone.

The same also applies for the cartridge design.

The atomizer version again has no openings (19). The material is drawn up via hose (61) and forced through the nozzle of the dispenser head.

The line that separates materials S1 and S2 is illustrated by horizontal dotted line (63). The stacked material layers are comparable to concordant layers.

In order to prevent air bubbles in front to tracker piston (37), the inner wall of container (1) or of the cartridge wall can be roughened or have longitudinal grooves (not illustrated). In addition, the upper side of the piston adapted to the cover contour of the donor, can be slotted.

The properties of the invention disclosed in the above description, the figures and the claims can be of importance individually or in any combination, to the embodiment of the invention.

I claim:

1. Dispenser for dispensing plural substances in portions comprising a vessel to contain said substances to be dispensed;

a cylinder and a pump mechanism in an upper portion of said vessel, said pump mechanism comprising a piston and a piston activator to move said piston upwardly and downwardly, there being a channel through said piston whereby a spout on the upper part of said dispenser communicates with said vessel, said piston being moveable in said cylinder, said cylinder having a diameter less than that of said vessel, said cylinder being open at its lower end to said vessel whereby during a downward motion of said actuator to move said piston downwardly, said substances within said cylinder are urged toward said spout to dispense a portion of said substances; and a pipe extending from said channel into a region of said vessel having a first of said substances, there being a set of passage openings arranged around said pipe for communicating between said channel and a region of said vessel having a second of said substances for providing a flow of said second substance outside said pipe to merge with said first substance in a direction of the cylinder chamber.

2. Dispenser for dispensing plural substances in portions comprising a vessel to contain plural substances to be dispensed;

a pump mechanism in an upper portion of said vessel, said pump mechanism comprising a piston and a piston activator to move said piston upwardly and downwardly, there being a channel through said piston whereby a spout on the upper part of said dispenser communicates with said vessel; and wherein said piston is moveable in a cylinder of a diameter less than that of said vessel, said cylinder being open at its lower end to said vessel whereby during a downward motion of said actuator to move said piston downwardly, said plural substances within said cylinder being urged toward said spout to dispense a portion of said plural substances;

said piston has a seat, and there is a partial flow means for said substances within said cylinder, said partial flow means having openings in the seat of said piston to allow one of said substances to flow through said openings in said piston seat and to merge with a flow of a second of said substances flowing upwardly through said channel.

3. Dispenser in accordance with claim 2, wherein said openings in said piston are in an orientation to cause said substances to merge in a Y shaped confluence.

4. Dispenser in accordance with claim 2, wherein said channel has at least one shoulder which reduces the interior cross-section of said channel.

5. Dispenser in accordance with claim 2, wherein said channel is multisectional.

6. Dispenser in accordance with claim 4, further comprising a pump spring located within said channel and being supported by said shoulder.

7. Dispenser, in accordance with claim 2, further comprising a cut-off valve located within said channel.

8. Dispenser, in accordance with claim 2, further comprising a cut-off valve positioned in an inlet opening of said cylinder.

9. Dispenser, in accordance with claim 2, further comprising a cut-off valve positioned in an upper section of said channel.

10. Dispenser, in accordance with claim 9, wherein said cut-off valve in the upper section of said channel has a piston plate which is displaceable in the direction of the spout against the pressure of a substance being pumped out.

11. Dispenser, in accordance with claim 2, further comprising an inlet tube communicating between said channel and said spout; and wherein said actuator is attached onto an upper end of a section of the inlet tube which is coaxial to and has a larger cross section than said channel.

12. Dispenser, in accordance with claim 2, wherein said piston is shaped like a funnel with an open top and narrows in a direction toward said spout.

13. Dispenser, in accordance with claim 2, wherein an interior of said vessel is formed as a replaceable cartridge; and a lower section of said cylinder is designed as a snap-in and connecting piece to said replaceable cartridge.

14. Dispenser, in accordance with claim 13, wherein there is a housing surrounding said cartridge, and a projection located at a base of said housing; and said cartridge has a follow-up piston, and said pump mechanism is located on a top edge of said housing by insertion of a lower end of said cylinder into said cartridge, said projection at the base of said housing being displaced in the direction of the pump mechanism upon a placing of the follow-up piston on the cartridge.

15. Dispenser, in accordance with claim 14 wherein said projection has the shape of an annular wall.

16. Dispenser, in accordance with claim 13, wherein the cartridge has openings aligned to the openings in said cylinder and is fitted with a sealing means outside thereof.

17. A method for dispensing plural substances in portions from a substance-flow-through vessel which has a pump mechanism in the upper portion thereof comprising drawing at least some of said plural substances up into a cylinder;

actuating a piston to move downwardly in said cylinder to expel said substances from said cylinder and upwardly through a channel to a spout;

providing a pipe within a partial section of the vessel, the pipe extending from the cylinder into a portion of the vessel containing one of said substances;

arranging a set of passage openings about an axis of said pipe for conducting a second of said substances in a direction of the cylinder chamber; and merging a stream of said second substance with a stream of said first substance.

18. A method as in claim 17 wherein at least a portion of said substances exit said cylinder through at least one opening in said piston and thereafter to merge, in said merging step, with a main body of said substances; and the method includes a step of employing the pipe to function as a wall divider.

* * * * *